US007983424B2

(12) United States Patent
Kjörling et al.

(10) Patent No.: US 7,983,424 B2
(45) Date of Patent: Jul. 19, 2011

(54) ENVELOPE SHAPING OF DECORRELATED SIGNALS

(75) Inventors: Kristofer Kjörling, Solna (SE); Jürgen Herre, Buckenhof (DE); Sascha Disch, Fürth (DE); Lars Villemoes, Järfälla (SE)

(73) Assignees: Fraunhofer-Gesellschaft zur Foerderung der Angewandten Forschung e.V., Munich (DE); Coding Technologies AB, Stockholm (SE)

( * ) Notice: Subject to any disclaimer, the term of this patent is extended or adjusted under 35 U.S.C. 154(b) by 1498 days.

(21) Appl. No.: 11/402,519

(22) Filed: Apr. 12, 2006

(65) Prior Publication Data

US 2006/0239473 A1 Oct. 26, 2006

Related U.S. Application Data

(60) Provisional application No. 60/671,583, filed on Apr. 15, 2005.

(30) Foreign Application Priority Data

Apr. 5, 2006 (WO) ..... PCT/EP2006/003097

(51) Int. Cl.
*H04R 5/00* (2006.01)
*G10L 19/00* (2006.01)

(52) U.S. Cl. ..... 381/22; 381/23; 704/219

(58) Field of Classification Search ..... 381/17–18, 381/20–23, 61, 63, 119, 94.2–94.3, 106; 700/94; 84/626, 630; 333/14; 455/72; 704/219, 704/225

See application file for complete search history.

(56) References Cited

U.S. PATENT DOCUMENTS

| | | | |
|---|---|---|---|
| 5,890,125 | A | 3/1999 | Davis et al. |
| 6,175,631 | B1 | 1/2001 | Davis et al. |
| 6,708,145 | B1 | 3/2004 | Liljeryd et al. |
| 2003/0018766 | A1 | 1/2003 | Duvvuru |
| 2006/0085200 | A1 | 4/2006 | Allamanche et al. |
| 2006/0171542 | A1 | 8/2006 | Den Brinker et al. |
| 2007/0071116 | A1 | 3/2007 | Oshikiri |

FOREIGN PATENT DOCUMENTS

| | | | |
|---|---|---|---|
| EP | 1158494 | A1 | 11/2001 |
| JP | 2001510953 | T | 8/2001 |
| JP | 2002032100 | A | 1/2002 |
| JP | 2002536679 | T | 10/2002 |
| WO | 9904498 | A2 | 1/1999 |
| WO | 0045379 | A2 | 8/2000 |
| WO | 2004086817 | A2 | 10/2004 |
| WO | 2005040749 | A1 | 5/2005 |

OTHER PUBLICATIONS

Herre, et al: Enhancing the Performance of Perceptual Audio Coders by Using Temporal Noise Shaping (TNS), 101st AES Convention, Nov. 8-11, 1996, Los Angeles, CA. Taiwanese Office Action and Search Report dated Oct. 20, 2008.

*Primary Examiner* — Vivian Chin
*Assistant Examiner* — Douglas J Suthers
(74) *Attorney, Agent, or Firm* — Laurence A. Greenberg; Werner H. Stemer; Ralph E. Locher

(57) ABSTRACT

The envelope of a decorrelated signal derived from an original signal can be shaped without introducing additional distortion, when a spectral flattener is used to spectrally flatten the spectrum of the decorrelated signal and the original signal prior to using the flattened spectra for deriving a gain factor describing the energy distribution between the flattened spectra, and when the so derived gain factor is used by an envelope shaper to timely shape the envelope of the decorrelated signal.

18 Claims, 10 Drawing Sheets

ENVELOPE SHAPING OF DECORRELATED SIGNALS

CROSS-REFERENCE TO RELATED APPLICATION

This application claims the benefit, under 35 U.S.C. §119 (e), of provisional application No. 60/671,583, filed Apr. 15, 2005; the prior application is herewith incorporated by reference in its entirety.

FIELD OF THE INVENTION

The present invention relates to temporal envelope shaping of signals and in particular to the temporal envelope shaping of a decorrelated signal derived from a downmix signal and additional control data during the reconstruction of a stereo or multi-channel audio signal.

BACKGROUND OF THE INVENTION IN PRIOR ART

Recent development in audio coding enables one to recreate a multi-channel representation of an audio signal based on a stereo (or mono) signal and corresponding control data. These methods differ substantially from older matrix based solutions, such as Dolby Prologic, since additional control data is transmitted to control the recreation, also referred to as up-mix, of the surround channels based on the transmitted mono or stereo channels. Such parametric multi-channel audio decoders reconstruct N channels based on M transmitted channels, where N>M, and the additional control data. Using the additional control data causes a significantly lower data rate than transmitting all N channels, making the coding very efficient, while at the same time ensuring compatibility with both M channel devices and N channel devices. The M channels can either be a single mono channel, a stereo channel, or a 5.1 channel representation. Hence, it is possible to have an 7.2 channel original signal, downmixed to a 5.1 channel backwards compatible signal, and spatial audio parameters enabling a spatial audio decoder to reproduce a closely resembling version of the original 7.2 channels, at a small additional bit rate overhead.

These parametric surround coding methods usually comprise a parameterisation of the surround signal based on time and frequency variant ILD (Inter Channel Level Difference) and ICC (Inter Channel Coherence) quantities. These parameters describe e.g. power ratios and correlations between channel pairs of the original multi-channel signal. In the decoder process, the re-created multichannel signal is obtained by distributing the energy of the received downmix channels between all the channel pairs described by the transmitted ILD parameters. However, since a multi-channel signal can have equal power distribution between all channels, while the signals in the different channels are very different, thus giving the listening impression of a very wide sound, the correct wideness is obtained by mixing signals with decorrelated versions of the same, as described by the ICC parameter.

The decorrelated version of the signal, often referred to as wet signal, is obtained by passing the signal (also called dry signal) through a reverberator, such as an all-pass filter. The output from the decorrelator has a time-response that is usually very flat. Hence, a dirac input signal gives a decaying noise-burst out. When mixing the decorrelated and the original signal it is for some transient signal types, like applause signals, important to shape the time envelope of the decorrelated signal to better match that one of the dry signal. Failing to do so will result in a perception of larger room size and unnatural sounding transients due to pre-echo type of artifacts.

In systems where the multi-channel reconstruction is done in a frequency transform domain having a low time resolution, temporal envelope shaping techniques can be employed, similarly to those used for shaping quantization noise such as Temporal Noise Shaping [J. Herre and J. D. Johnston, "Enhancing the performance of perceptual audio coding by using temporal noise shaping (TNS)," in 101$^{st}$ AES Convention, Los Angeles, November 1996] of perceptual audio codecs like MPEG-4 AAC. This is accomplished by means of prediction across frequency bins, where the temporal envelope is estimated by linear prediction in the frequency direction on the dry signal, and the filter obtained is applied, again in the frequency direction, on the wet signal.

One may for example consider a delay line as decorrelator and a strongly transient signal, such as applause or a gun-shot, as signal to be up-mixed. When no envelope shaping would be performed, a delayed version of the signal would be combined with the original signal to reconstruct a stereo or multi-channel signal. Such, the transient signal would be present twice in the up-mixed signal, separated by the delay time, causing an unwanted echo type effect.

In order to achieve good results on highly critical signals, the time-envelope of the decorrelated signal needs to be shaped with a very high time resolution, such cancelling out a delayed echo of a transient signal or masking it by reducing its energy to the energy contained in the carrier channel at the time.

This broad band gain adjustment of the decorrelated signal can be done over windows as short as 1 ms [U.S. patent application, "Diffuse Sound Shaping for BCC Schemes and the Like", Ser. No. 11/006,492, Dec. 7, 2004]. Such high time-resolutions of the gain adjustment for the decorrelated signal inevitably leads to additional distortion. In order to minimise the added distortion for non-critical signals, i.e. where the temporal shaping of the decorrelated signal is not crucial, detection mechanism are incorporated in the encoder or decoder, that switch the temporal shaping algorithm on and off, according to some sort of pre-defined criteria. The drawback is that the system can become extremely sensitive to detector tuning.

Throughout the following description the term decorrelated signal or wet signal is used for the, possibly gain adjusted (according to the ILD and ICC parameters) decorrelated version of a downmix signal, and the term downmix signal, direct signal or dry signal is used for the, possibly gain adjusted downmix signal.

In prior art implementations, a high time-resolution gain adjustment, i.e. a gain adjustment based on samples of the dry signal as short as milliseconds, leads to an additional significant distortion for non-critical signals. These are non-transient signals having a smooth timely evolution, for example music signals. The prior art approach of switching the gain adjustment off for such non-critical signals introduces a new and strong dependency of the quality of audio perception on the detection mechanism, which is, of course, mostly disadvantageous and may even introduce additional distortion, when the detection fails.

SUMMARY OF THE INVENTION

It is the object of the present invention to provide a concept to shape the envelope of a decorrelated signal more efficiently, avoiding the introduction of additional signal distortion.

In accordance with a first aspect of the present invention this object is achieved by an apparatus for processing a decorrelated signal derived from an original signal or a combination signal derived by combining the original signal and the decorrelated signal, comprising: a spectral flattener for spectral flattening of the decorrelated signal, a signal derived from the decorrelated signal, the original signal, a signal derived from the original signal or the combination signal to obtain a flattened signal, the spectral flattener being operative such that the flattened signal has a flatter spectrum than a corresponding signal before flattening; and a time envelope shaper for time envelope shaping the decorrelated signal or the combination signal using information on the flattened signal.

In accordance with a second aspect of the present invention this object is achieved by a spatial audio decoder, comprising: an input interface for receiving an original signal derived from a multi channel signal having at least two channels and for receiving spatial parameters describing an interrelation between a first channel and a second channel of the multi channel signal; a decorrelator for deriving a decorrelated signal from the original signal using the spatial parameters; a spectral flattener for spectral flattening of the decorrelated signal, a signal derived from the decorrelated signal, the original signal, a signal derived from the original signal or a combination signal derived by combining the original signal and the decorrelated signal to obtain a flattened signal, the spectral flattener being operative such that the flattened signal has a flatter spectrum than a corresponding signal before flattening; and a time envelope shaper for time envelope shaping the decorrelated signal or the combination signal using information on the flattened signal.

In accordance with a third aspect of the present invention this object is achieved by a receiver or audio player, having an apparatus for processing a decorrelated signal derived from an original signal or a combination signal derived by combining the original signal and the decorrelated signal, comprising: a spectral flattener for spectral flattening of the decorrelated signal, a signal derived from the decorrelated signal, the original signal, a signal derived from the original signal or the combination signal to obtain a flattened signal, the spectral flattener being operative such that the flattened signal has a flatter spectrum than a corresponding signal before flattening; and a time envelope shaper for time envelope shaping the decorrelated signal or the combination signal using information on the flattened signal.

In accordance with a fourth aspect of the present invention this object is achieved by a method for processing a decorrelated signal derived from an original signal or a combination signal derived by combining the original signal and the decorrelated signal, the method comprising: spectrally flattening the decorrelated signal, a signal derived from the decorrelated signal, the original signal, a signal derived from the original signal or the combination signal to obtain a flattened signal, the flattened signal having a flatter spectrum than a corresponding signal before flattening; and time envelope shaping the decorrelated signal or the combination signal using information on the flattened signal.

In accordance with a fifth aspect of the present invention this object is achieved by a method of receiving or audio playing, the method having a method for processing a decorrelated signal derived from an original signal or a combination signal derived by combining the original signal and the decorrelated signal, the method comprising: spectrally flattening the decorrelated signal, a signal derived from the decorrelated signal, the original signal, a signal derived from the original signal or the combination signal to obtain a flattened signal, the flattened signal having a flatter spectrum than a corresponding signal before flattening; and time envelope shaping the decorrelated signal or the combination signal using information on the flattened signal.

In accordance with a sixth aspect of the present invention this object is achieved by a computer program for performing, when running on a computer, a method in accordance with any of the above method claims.

The present invention is based on the finding that the envelope of a decorrelated signal derived from an original signal or of a combination signal derived by combining the original signal and the decorrelated signal can be shaped without introducing additional distortion, when a spectral flattener is used to spectrally flatten the spectrum of the decorrelated signal or the combination signal and the original signal to use the flattened spectra for deriving a gain factor describing the energy distribution between the flattened spectra, and when the so derived gain factor is used by an envelope shaper to shape the time envelope of the decorrelated signal or of the combination signal.

Flattening the spectrum has the advantage that transient signals are hardly affected by flattening, since these signals already have a rather flat spectrum. Moreover, the gain factors derived for non-transient signals are being brought closer to unity. Therefore both demands shaping transient signals and not altering non-transient signals can be met at a time, without having to switch envelope shaping on and off during a decoding process.

The same advantages hold for shaping of combination signals that are a combination of an original signal and a decorrelated signal which is derived from said original signal. Such a combination may be derived by first deriving a decorrelated signal from the original signal and by then simply adding the two signals. For example, possible pre-echo type of artifacts can be advantageously suppressed in the combination signal by shaping the combination signal using the flattened spectrum of the combination signal and the flattened spectrum of the original signal to derive gain factors used for shaping.

The present invention relates to the problem of shaping the temporal envelope of decorrelated signals that are frequently used in reconstruction of multi-channel audio signals. The invention proposes a new method that retains the high time resolution for applause signals, while minimising the introduced distortion for other signal types. The present invention teaches a new way to perform the short time energy adjustment that significantly reduces the amount of distortion introduced, making the algorithm much more robust and less dependent on a very accurate detector controlling the operation of a temporal envelope shaping algorithm.

The present invention comprises the following features:

- performing spectral flattening of the direct sound signal or a signal derived from the direct sound signal, over a time segment significantly longer than the time segment used for temporal envelope shaping;
- performing spectral flattening of the decorrelated signal, over a time segment significantly longer than the time segment used for temporal envelope shaping;
- calculating the gain factor for the short time segment used for envelope shaping based on the long time spectrally flattened signals;
- performing the spectral flattening in the time domain by means of LPC (Linear Predictive Coding);
- performing the spectral flattening in the subband domain of a filterbank;
- performing spectral flattening prior to frequency direction based prediction of temporal envelope;

performing energy correction for frequency direction based prediction of temporal envelope.

The following problems are completely or significantly reduced by the present invention, that would otherwise arise when attempting very short time broad band energy correction of a decorrelated signal:

the problem of introducing a significant amount of distortion especially for signal segments where the temporal shaping is not required;

the problem of introducing high dependency on a detector indicating when the short time energy correction should be operated, due to the distortion introduced for arbitrary signals.

The present invention outlines a novel method for calculating the required gain adjustment that retains the high time-resolution but minimises the added distortion. This means that a spatial audio system utilising the present invention is not as dependent on a detection mechanism that switches the temporal shaping algorithm off for non-critical items, since the added distortion for items where the temporal shaping is not required is kept to a minimum.

The novel invention also outlines how to get an improved estimate of the temporal envelope of the dry signal to be applied to the wet signal when estimating it by means of linear prediction in the frequency direction within the transform domain.

In one embodiment of the present invention an inventive apparatus for processing a decorrelated signal is applied within the signal processing path of a 1 to 2 upmixer after the derivation of the wet signal from the dry signal.

Firstly, a spectrally flattened representation of the wet signal and of the dry signal is computed for a large number of consecutive time domain samples (a frame). Based on those spectrally flattened representations of the wet and the dry signal, gain factors to adjust the energy of a smaller number of samples of the wet signal are then computed based on the spectrally flattened representations of the wet and the dry signal. By spectrally flattening, the spectrum of a transient signal, which is rather flat by nature, is hardly altered, whereas the spectrum of periodic signals is strongly modified. Using a signal representation with flattened spectra therefore achieves both, shaping the envelope of the decorrelated wet signal heavily, when a transient signal is predominant and shaping the envelope of the wet signal merely, when smooth or periodic signals carry the most energy in the dry channel. Thus, the present invention significantly reduces the amount of distortion added to the signal especially for signal segments where the temporal envelope shaping is basically not required. Furthermore, the high dependency on a prior art detector indicating when short time energy corrections should be applied, is avoided.

In a further embodiment of the present invention an inventive apparatus operates on an upmixed (combined) monophonic signal which is derived by an upmixer that combines an original signal and a decorrelated signal derived from the original signal to compute the upmixed monophonic signal. Such upmixing is a standard strategy during reconstruction of multi-channel signals for deriving individual channels that have acoustic properties of the corresponding original channel of the multi-channel signal. Since the inventive apparatus can be applied after such upmixing, already existing set ups can easily be extended.

In a further embodiment of the present invention, the temporal envelope shaping of a decorrelated signal is implemented within the subband domain of a filterbank. There, flattened spectral representations of the various subband signals are derived for each subband individually for a high number of consecutive samples. Based on the spectrally flattened long-term spectra, the gain factor to shape the envelope of the wet signal according to the dry signal is computed for a sample representing a much lower time period of the original signal. The advantages with respect to the perceptual quality of the reconstructed audio signal are the same as for the example described above. Furthermore, the possibility to implement the inventive concept within a filterbank representation has the advantage, that already existing multi-channel audio decoders using filterbank representations can be modified to implement the inventive concept without major structural and computational efforts.

In a further embodiment of the present invention, the temporal envelope shaping of the wet signal is performed within the subband domain using linear prediction. Therefore, linear prediction is applied in the frequency direction of the filterbank, allowing to shape the signal with higher time resolution than natively available in the filterbank. Again, the final energy correction is computed by estimating gain curves for a number of consecutive subband samples of the filterbank.

In a modification of the previously described embodiment of the present invention, the estimation of the parameters describing the whitening of the spectrum are smoothed over a number of neighbouring time samples of the filterbank. Therefore, the risk of applying a wrongly derived inverse filters to whiten the spectrum when transient signals are present, is further reduced.

DETAILED DESCRIPTION OF PREFERRED EMBODIMENTS

Figure 1A:
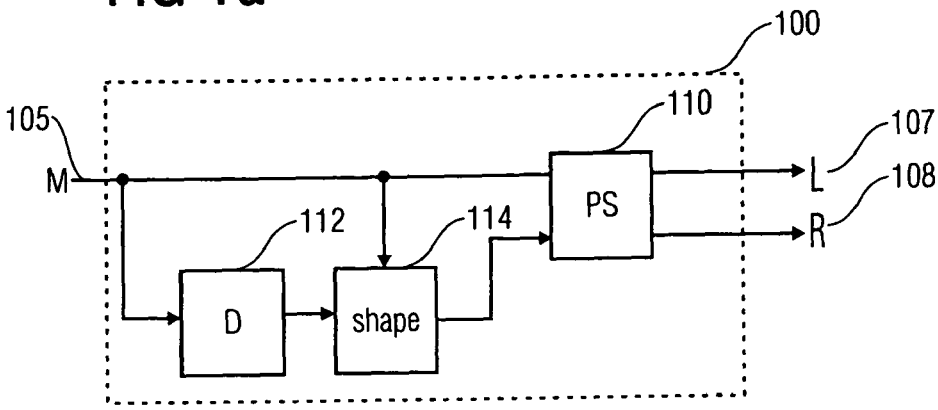
FIG. 1*a* shows the application of an inventive apparatus within a 1 to 2 upmixer stage.

FIG. 1 is showing a 1 to 2 channel parametric upmixing device 100 to upmix a submitted mono channel 105 into two stereo channels 107 and 108, additionally using spatial parameters. The parametric upmixing device 100 has a parametric stereo upmixer 110, a decorrelator 112 and an inventive apparatus for processing a decorrelated signal 114.

The transmitted monophonic signal 105 is input into the parametric stereo upmixer 110 as well as into the decorrelator 112, that derives a decorrelated signal from the transmitted signal 105 using a decorrelation rule, that could, for example, be implemented by simply delaying the signal for a given time. The decorrelated signal produced by the decorrelator 112 is input into the inventive apparatus (shaper) 114, that additionally receives the transmitted monophonic signal as input. The transmitted monophonic signal is needed to derive the shaping rules used to shape the envelope of the decorrelated signal, as elaborated in more detail in the coming paragraphs.

Finally, a envelope shaped representation of the decorrelated signal is input into the parametric stereo upmixer, which derives the left channel 107 and the right channel 108 of a stereo signal from the transmitted monophonic signal 105 and from the envelope shaped representation of the decorrelated signal.

To better understand the inventive concept and the different presented embodiments of the present invention, the upmixing process of a transferred monophonic signal into a stereo signal using the additionally submitted special parameters is explained within the following paragraphs:

It is known from prior art that two audio channels can be reconstructed based on a downmix channel and a set of spatial parameters carrying information on the energy distribution of the two original channels upon which the downmix was made as well as information on the correlation between the two original channels. The embodiment in FIG. 1 exemplifies a frame work for the present invention.

In FIG. 1, the downmixed mono signal 105 is fed into a decorrelator unit 112 as well as a up-mix module 110. The decorrelator unit 112 creates a decorrelated version of the input signal 105, having the same frequency characteristics and the same long term energy. The upmix module calculates an upmix matrix based on the spatial parameters and the output channels 107 and 108 are synthesised. The upmix module 110 can be explained according to:

$$\begin{bmatrix} Y_1[k] \\ Y_2[k] \end{bmatrix} = \begin{bmatrix} c_l & 0 \\ 0 & c_r \end{bmatrix} \begin{bmatrix} \cos(\alpha+\beta) & \sin(\alpha+\beta) \\ \cos(-\alpha+\beta) & \sin(-\alpha+\beta) \end{bmatrix} \begin{bmatrix} X[k] \\ Q[k] \end{bmatrix}$$

with the parameters $c_l$, $C_r$, $\alpha$ and $\beta$ being derived from the ILD parameters and the ICC parameters transmitted in the bitstream. The signal X[k] is the received downmix signal 105, the signal Q[k] is the de-correlated signal, being a decorrelated version of the input signal 105. The output signals 107 and 108 are denoted $Y_1[k]$ and $Y_2[k]$.

The new module 114 is devised to shape the time envelope of the signal being output of the decorrelator module 112 so that the temporal envelope matches that of the input signal 105. The details of module 100 will be elaborated extensively on in a later section.

It is evident from the above and from FIG. 1 that the upmix module generates a linear combination of the downmix signal and the decorrelated version of the same. It is thus evident that the summation of the decorrelated signal and the downmix signal can be done within the upmix as outlined above or in a subsequent stage. Hence, the two output channels above 107 and 108 can be replaced by four output channels, where two are holding the decorrelated version and the direct-signal version of the first channel, and two are holding the decorrelated version and the direct-signal version of the second channel. This is achieved by replacing the above upmix equation by:

$$\begin{bmatrix} Y_1^{wet}[k] \\ Y_2^{wet}[k] \end{bmatrix} = \begin{bmatrix} c_l & 0 \\ 0 & c_r \end{bmatrix} \begin{bmatrix} \cos(\alpha+\beta) & \sin(\alpha+\beta) \\ \cos(-\alpha+\beta) & \sin(-\alpha+\beta) \end{bmatrix} \begin{bmatrix} 0 \\ Q[k] \end{bmatrix}$$

$$\begin{bmatrix} Y_1^{dry}[k] \\ Y_2^{dry}[k] \end{bmatrix} = \begin{bmatrix} c_l & 0 \\ 0 & c_r \end{bmatrix} \begin{bmatrix} \cos(\alpha+\beta) & \sin(\alpha+\beta) \\ \cos(-\alpha+\beta) & \sin(-\alpha+\beta) \end{bmatrix} \begin{bmatrix} X[k] \\ 0 \end{bmatrix}$$

The reconstructed output channels are subsequently obtained by:

$$\begin{bmatrix} Y_1[k] \\ Y_2[k] \end{bmatrix} = \begin{bmatrix} Y_1^{dry}[k] \\ Y_2^{dry}[k] \end{bmatrix} + \begin{bmatrix} Y_1^{wet}[k] \\ Y_2^{wet}[k] \end{bmatrix}.$$

Given the above, it is clear that an inventive apparatus can be implemented into a decoding scheme as well before the final up-mixing, as shown in FIG. 1, as after the upmixing. Moreover, the inventive apparatus can be used to shape the envelope of a decorrelated signal as well in the time domain as in a QMF subband domain.

Figure 1B:
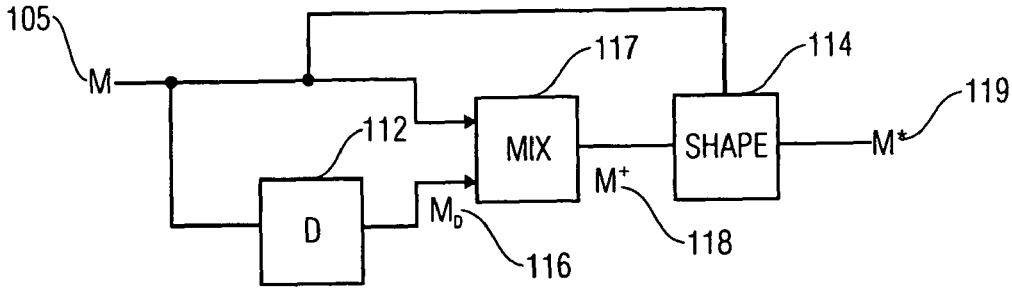
FIG. 1*b* shows a further example of an application of an inventive apparatus.

FIG. 1*b* shows a further preferred embodiment of the present invention where an inventive shaper 114 is used to shape a combination signal 118 derived from the transmitted monophonic signal 105 and a decorrelated signal 116 derived from the transmitted monophonic signal 105. The embodiment of FIG. 1*b* is based on the embodiment of FIG. 1. Therefore, components having the same functionality have the same marks.

A decorrelator 112 derives the decorrelated signal 116 from the transmitted monophonic signal 105. A mixer 117 receives the decorrelated signal 116 and the transmitted monophonic signal 105 as an input and derives the combination signal 118 by combining the transmitted signal 105 and the decorrelated signal 116.

Combination may in that context mean any suitable method to derive one single signal from two or more input signals. In the simplest example the combination signal 118 is derived by simply adding the transmitted monophonic signal 105 and the decorrelated signal 116.

The shaper 114 receives as an input the combination signal 118 that is to be shaped. To derive the gain factors for shaping, the transmitted monophonic signal 105 is also input into the shaper 114. A partly decorrelated signal 119 is derived at the output of the shaper 114 that has a decorrelated signal component and an original signal component without introducing additional audible artifacts.

Figure 2A:
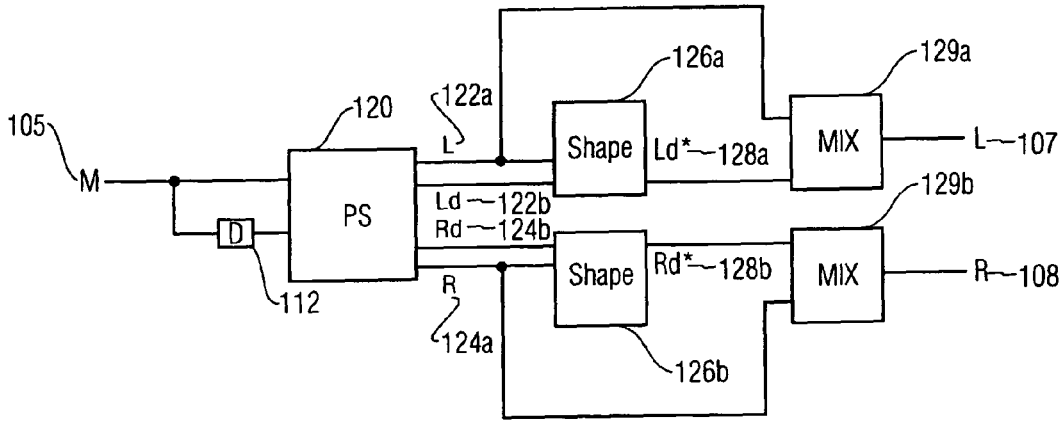
FIG. 2*a* shows an alternative placement possibility of the inventive apparatus.

FIG. 2 shows a configuration, where the envelope shaping of the wet signal part can be applied after the upmix.

FIG. 2 shows an inventive parametric stereo upmixer 120 and a decorrelator 112. The monophonic signal 105 is input into the decorrelator 112 and into the parametric stereo upmixer 120. The decorrelator 112 derives a decorrelated signal from the monophonic signal 105 and inputs the decorrelated signal into the parametric stereo upmixer 120. The parametric stereo upmixer 120 is based on the parametric stereo upmixer 110 already described in FIG. 1. The parametric stereo upmixer 120 differentiates from the parametric stereo upmixer 110 in that the parametric stereo upmixer 120 derives a dry part 122*a* and a wet part 122*b* of the left channel and a dry part 124*a* and a wet part 124*b* of the right channel. In other words, the parametric stereo upmixer 120 up-mixes the dry signal parts and the wet signal parts for both channels separately. This might be implemented in accordance with the formulas given above.

As the wet signal parts 122*b* and 124*b* have been up-mixed but not shaped, a first shaper 126*a* and a second shaper 126*b* are additionally present in the inventive up-mixing set shown in FIG. 2. The first shaper 126*a* receives at its input the wet signal 122*b* to be shaped and as a reference signal a copy of the left signal 122*a*. At the output of the first shaper 126*a*, a shaped dry signal 128*a* is provided. The second shaper 126*b* receives the right dry signal 124*a* and the right wet signal 124*b* at its input and derives the shaped wet signal 128*b* of the right channel as its output. To finally derive the desired left signal 107 and right signal 108, a first mixer 129*a* and a second mixer 129*b* are present in the inventive setup. The first mixer 129*a* receives at its input a copy of the left up-mixed signal 122*a* and the shaped wet signal 128*a* to derive (at its output) the left signal 107. The second mixer 129*b* derives the right channel 108 in an analogous way, receiving the dry right signal 124*a* and the shaped wet right signal 128*b* at its inputs. As can be seen from FIG. 2, this setup can be operated as an alternative to the embodiment shown in FIG. 1.

Figure 2B:
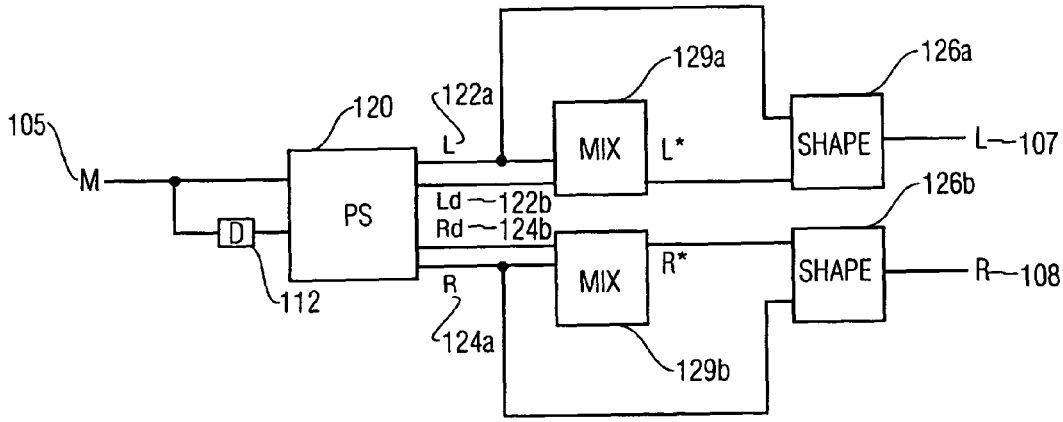
FIG. 2*b* shows a further example for the placement of an inventive apparatus.

FIG. 2*b* shows a preferred embodiment of the present invention being a modification of the embodiment previously shown in FIG. 2 and therefore the same components share the same marks.

In the embodiment shown in FIG. 2*b*, the wet signal 122*b* is first mixed with its dry counterpart 122*a* to derive a left intermediate channel L* and the wet signal 124*b* is mixed with its dry counterpart 124*a* to receive a right intermediate channel R*. Thus, a channel comprising left-side information and a channel comprising right-side information is generated. There is, however, still the possibility of having introduced audible artifacts by the wet signal components 122*b* and 124*b*. Therefore, the intermediate signals L and R are shaped by corresponding shapers 126*a* and 126*b* that additionally receive as an input the dry signal parts 122*a* and 124*a*. Thus, finally a left channel 107 and a right channel 108 can be derived having the desired spatial properties.

To summarize shortly, the embodiment shown in FIG. 2*b* differs from the embodiment shown in FIG. 2*b* in that the wet and dry signals are upmixed first and the shaping is done on the so derived combinations signal (L* and R*). Thus, FIG. 2*b* shows an alternative set-up to solve the common problem of having two derive to channels without introducing audible distortions by the used decorrelated signal parts. Other ways of combining two signal parts to derive a combination signal to be shaped, such as for example multiplying or folding signals, are also suited to implement the inventive concept of shaping using also spectrally flattened representations of the signals.

Figure 3A:
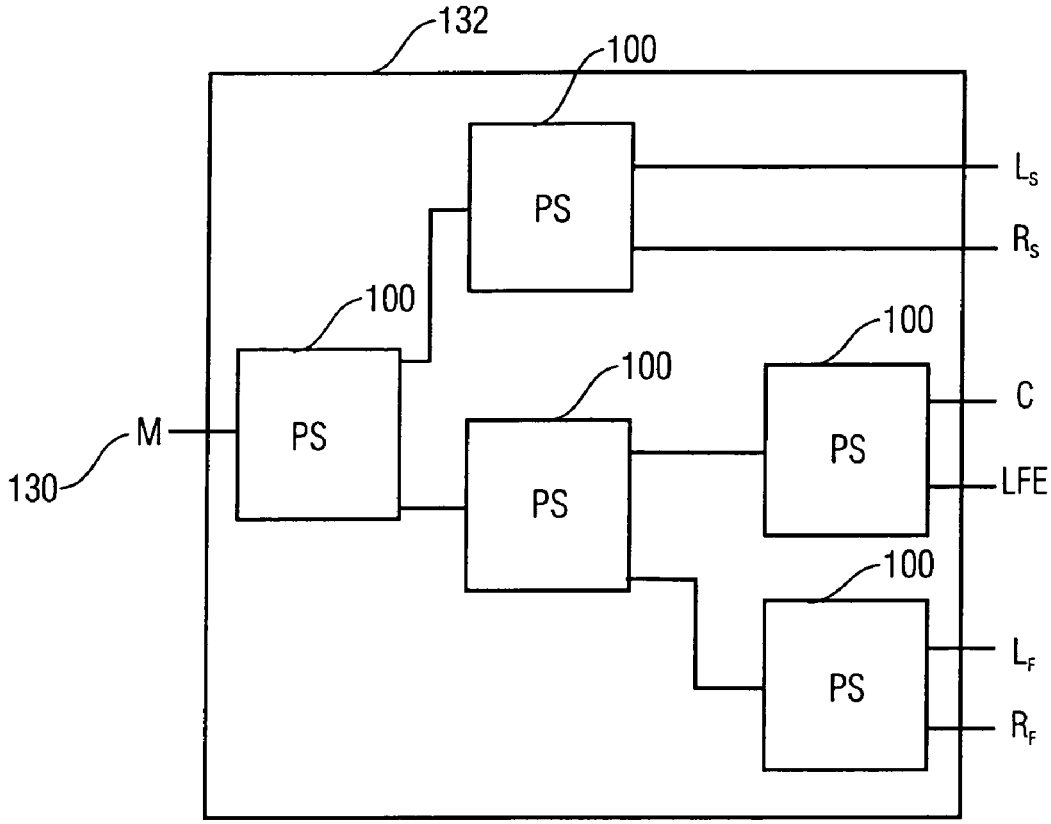
FIG. 3*a* shows the use of an inventive apparatus within a multi-channel audio decoder.

As shown in FIG. 3*a*, two channel reconstruction modules can be cascaded into a tree-structured system that iteratively recreates, for example, 5.1 channels from a mono downmix channel 130. This is outlined in FIG. 3*a*, where several inventive upmixing modules 100 are cascaded to recreate 5.1 channels from the monophonic downmix channel 130.

The 5.1 channel audio decoder 132 shown in FIG. 3*a* comprises several 1 to 2 upmixers 100, that are arranged in a tree-like structure. The upmix is done iteratively, by subsequent upmixing of mono channels to stereo channels, as already known in the art, however using inventive 1 to 2 upmixer blocks 100 that comprise an inventive apparatus for processing a decorrelated signal to enhance the perceptual quality of the reconstructed 5.1 audio signal.

The present invention teaches that the signal from the decorrelator must undergo accurate shaping of its temporal envelope in order to not cause unwanted artifacts when the signal is mixed with the dry counterpart. The shaping of the temporal envelope can take place directly after the decorrelator unit as shown in FIG. 1 or, alternatively, upmixing can be performed after the decorrelator for both, the dry signal and the wet signal separately, and the final summation of the two is done in the time domain after the synthesis filtering, as sketched in FIG. 2. This can alternatively be performed in the filterbank domain also.

Figure 3B:
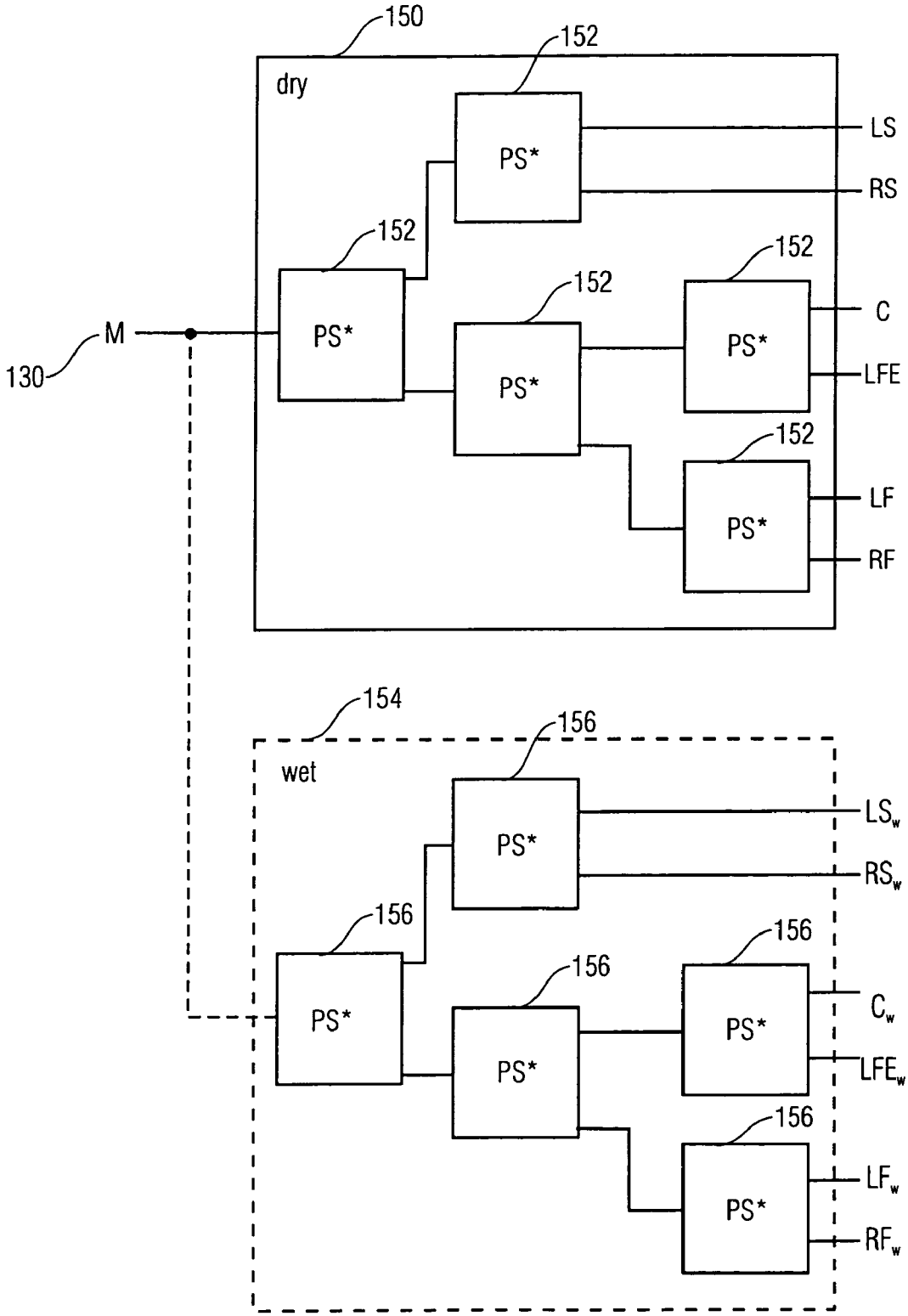
FIG. 3*b* shows an inventive apparatus within a further multi-channel audio decoder.

To support the above mentioned separate generation of dry signals and wet signals, a hierarchical structure as shown in FIG. 3*b* is used in a further embodiment of the present invention. FIG. 3*b* is showing a first hierarchical decoder 150 comprising several cascaded modified upmixing modules 152 and a second hierarchical decoder 154 comprising several cascaded modified upmixing modules 156.

To achieve the separate generation of the dry and the wet signal paths, the monophonic downmix signal 130 is split and input into the first hierarchical decoder 150 as well as into the second hierarchical decoder 154. The modified upmixing modules 152 of the first hierarchical decoder 150 differentiate from the upmixing modules 100 of the 5.1 channel audio decoder 132 in that they are only providing the dry signal parts at their outputs. Correspondingly, the modified upmixing modules 156 of the second hierarchical decoder 154 are only providing the wet signal parts at their outputs. Therefore, by implementing the same hierarchical structure as already in FIG. 3*a*, the dry signal parts of the 5.1 channel signal are generated by the first hierarchical decoder 150, whereas the wet signal parts of the 5.1 channel signal are generated by the second hierarchical decoder 154. Hence the generation of the wet and dry signals can for example be performed within the filterbank domain, whereas the combination of two signal parts can be performed in the time domain.

The present invention further teaches that the signals used for extraction of the estimated envelopes that are subsequently used for the shaping of the temporal envelope of the wet signal shall undergo a long term spectral flattening or whitening operation prior to the estimation process in order to minimise the distortion introduced when modifying the decorrelated signal using very short time segments, i.e. time segments in the 1 ms range. The shaping of the temporal envelope of the decorrelated signal can be done by means of short term energy adjustment in the subband domain or in the time domain. The whitening step as introduced by the present invention ensures that the energy estimates are calculated on an as large time frequency tile as possible. Stated differently, since the duration of the signal segment is extremely short, it is important to estimate the short term energy over an as large frequency range as possible, in order to maximise the "number of data-points" used for energy calculation. However, if one part of the frequency range is very dominant over the rest, i.e. a steep spectral slope, the number of valid data points becomes too small, and the estimate obtained will be prone to vary from estimate to estimate, imposing unnecessary fluctuations of the applied gain values.

The present invention further teaches that when the temporal envelope of the decorrelated signal is shaped by means of prediction in the frequency direction [J. Herre and J. D. Johnston, "Enhancing the performance of perceptual audio coding by using temporal noise shaping (TNS)," in 101st AES Convention, Los Angeles, November 1996.], the frequency spectrum used to estimate the predictor should undergo a whitening stage, in order to achieve a good estimate of the temporal envelope that shall be applied to the decorrelated signal. Again, it is not desirable to base the estimate on a small part of the spectrum as would be the case for a steep sloping spectrum without spectral whitening.

Figure 4A:
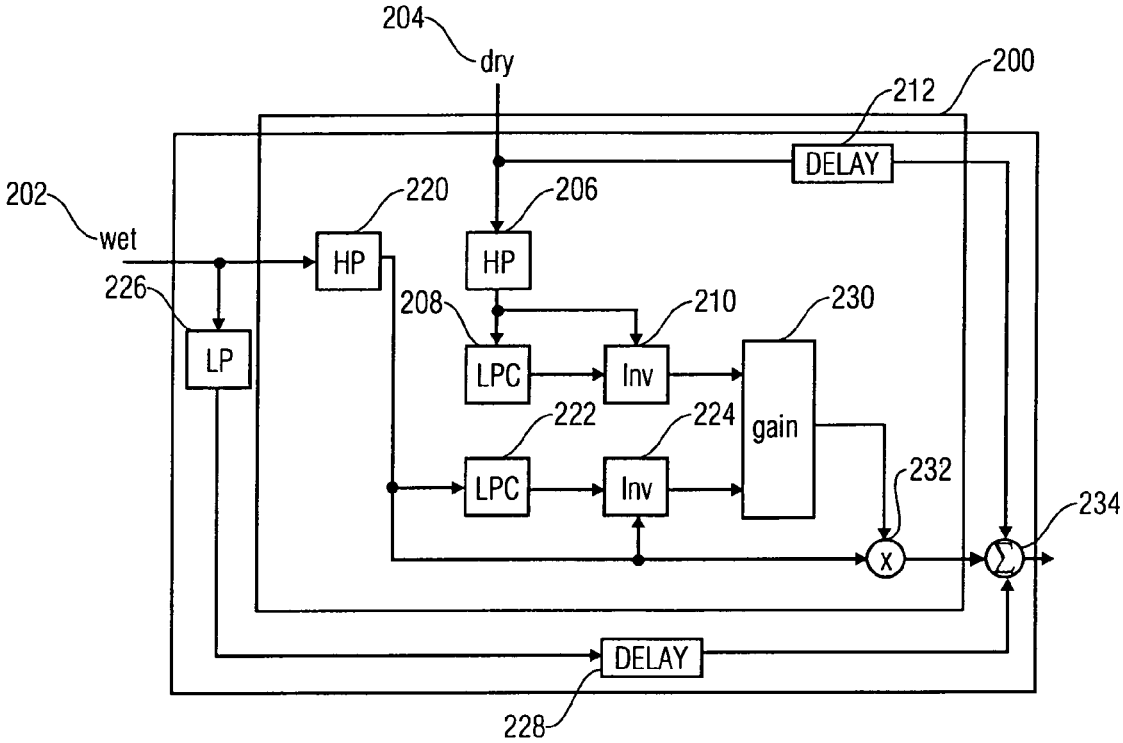
FIG. 4*a* shows a preferred embodiment of an inventive apparatus.

FIG. 4*a* shows a preferred embodiment of the present invention operative in the time domain. The inventive apparatus for processing a decorrelated signal 200 receives the wet signal 202 to be shaped and the dry signal 204 as input, wherein the wet signal 202 is derived from the dry signal 204 in a previous step, that is not shown in FIG. 4.

The apparatus 200 for processing a decorrelated signal 202 is having a first high path filter 206, a first linear prediction device 208, a first inverse filter 210 and a first delay 212 in signal path of the dry signal and a second high-pass filter 220, a second linear prediction device 222, a second inverse filter 224, a low-pass filter 226 and a second delay 228 in the signal path of the wet signal. The apparatus further comprises a gain calculator 230, a multiplier (envelope shaper) 232 and an adder (upmixer) 234.

On the dry signal side, the input of the dry signal is split and the input into the first high-pass filter 206 and the first delay 212. An output of the high-pass filter 206 is connected with an input of the first linear prediction device 208 and with an first input of the first inverse filter 210. An output of the first linear prediction device 208 is connected to a second input of the inverse filter 210, and an output of the inverse filter 210 is connected to a first input of the gain calculator 230. In the wet signal path, the wet signal 202 is split and input into an input of the second high-pass filter 220 and to an input of the low-pass filter 226. An output of the lowpass filter 226 is connected to the second delay 228. An output of the second high-pass filter 220 is connected to an input of the second linear prediction device 222 and to a first input of the second inverse filter 224. A output of the second linear prediction device 222 is connected to a second input of the second inverse filter 224, an output of which is connected to a second input of the gain calculator 230. The envelope shaper 232 receives at a first input the high-pass filtered wet signal 202 as supplied at the output of the second high-pass filter 220. A second input of the envelope shaper 232 is connected to an output of the gain calculator 230. An output of the envelope shaper 232 is connected to a first input of the adder 234, that receives at a second input a delayed dry signal, as supplied from an output of the first delay 212, and which further receives at a third input a delayed low frequency portion of the wet signal, as supplied by an output of the second delay 228. At an output of the adder 232, the completely processed signal is supplied.

In the preferred embodiment of the present invention shown in FIG. 4*a*, the signal coming from the decorrelator (the wet signal 202) and the corresponding dry signal 204 are input into the second high-pass filter 220, and the first high-pass filter 206, respectively, where both signals are high-pass filtered at approximately 2 kHz cut-off frequency. The wet signal 202 is also low-pass filtered by the low-pass filter 226, that is having a path band similar to the stop band of the second high-pass filter 220. The temporal envelope shaping of the decorrelated (wet) signal 202 is thus only performed in the frequency range above 2 kHz. The low-pass part of the wet signal 202 (not subject to temporal envelope shaping) is delayed by the second delay 208 to compensate for the delay introduced when shaping the temporal envelope of the high-pass part of the decorrelated signal 202. The same is true for the dry signal part 204, that receives the same delay time by the first delay 212, so that at the adder 234, the processed high-pass filtered part of the wet signal 202, the delayed low-pass part of the wet signal 202 and the delayed dry signal 204 can be added or upmixed to yield a finally processed upmixed signal.

According to the present invention, after the high-pass filtering, the long-term spectral envelope is to be estimated. It is important to note, that the time segment used for the long-term spectral envelope estimation is significantly longer than the time segments used to do the actual temporal envelope shaping. The spectral envelope estimation and subsequent inverse filtering typically operates on time segments in the range of 20 ms while the temporal envelope shaping aims at shaping the temporal envelope with an accuracy in the 1 ms range. In the preferred embodiment of the present invention shown in FIG. 4*a*, the spectral whitening is performed by inverse filtering with the first inverse filter 210 operating on the dry signal and the second inverse filter 224 operating on the wet signal 202. To obtain the required filter coefficients for the first inverse filter 210 and the second inverse filter 224, the spectral envelopes of the signals are estimated by means of linear prediction by the first linear prediction device 208 and the second linear prediction device 222. The spectral envelope H(z) of a signal can be obtained using linear prediction, as described by the following formulas:

$$H(z) = \frac{G}{A(z)}$$

where $$A(z) = 1 - \sum_{k=1}^{p} \alpha_k z^{-k}$$

is the polynomial obtained using the autocorrelation method or the covariance method [Digital Processing of Speech Signals, Rabiner & Schafer, Prentice Hall, Inc., Englewood Cliffs, N.J. 07632, ISBN 0-13-213603-1, Chapter 8], and G is a gain factor. The order p of the above polynomial is called predictor order.

As shown in FIG. 4*a*, the linear prediction of the spectral envelope of the signal is done in parallel for the dry signal part 204 and for the wet signal part 202. With these estimates of the spectral envelope of the signals, inverse filtering of the high-pass filtered dry signal 204 and the wet signal 202 can be performed, i.e. the flattening of the spectrum (spectral whitening) can be done while the energy within the signals has to be preserved. The degree of spectral whitening, i.e. the extent to which the flattened spectrum becomes flat, can be controlled by the varying predictor order p, i.e. by limiting the order of the polynomial A(z), thus limiting the amount of fine structure that can be described by H(z). Alternatively, a bandwidth expansion factor can be applied to the polynomial A(z). The bandwidth expansion factor is defined according to the following formula, based on the polynomial A(z).

$$A(\rho z)=a_0z^0\rho^0+a_1z^1\rho^1+a_2z^2\rho^2+\ldots+a_pz^p\rho^p$$

Figure 4B:
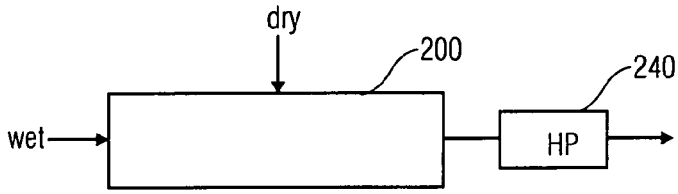
FIG. 4*b* shows a modification of the inventive apparatus of FIG. 4*a;*
Figure 4C:
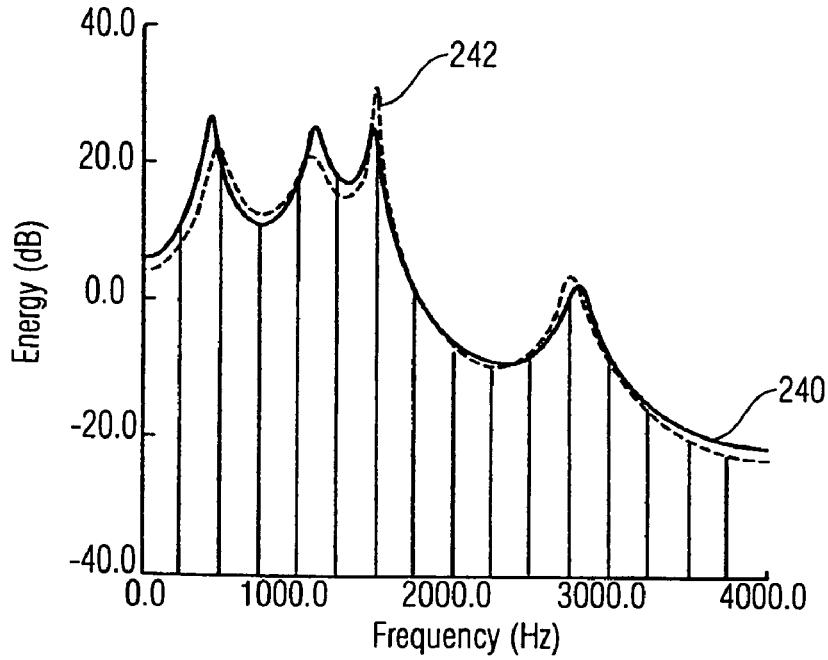
FIG. 4*c* shows an example of linear predictive coding.
Figure 4D:
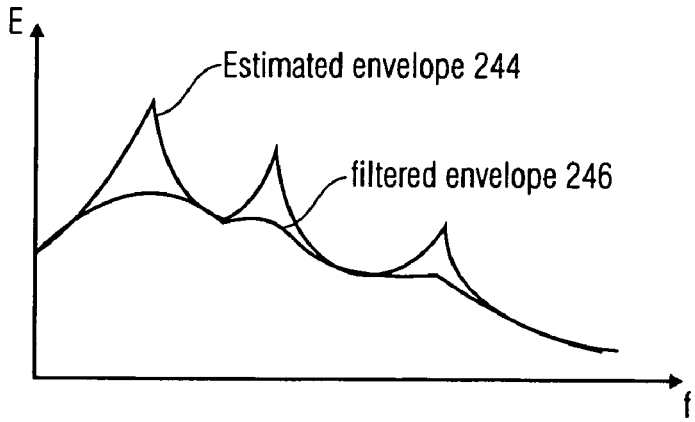
FIG. 4*d* shows the application of a bandwidth expansion factor at linear predictive coding.

The temporal envelope shaping and the effect of the bandwidth expansion factor ρ are illustrated in FIGS. 4*c* and 4*d*.

FIG. 4*c* gives an example for the estimation of the spectral envelope of a signal, as it could be done by the first linear prediction device 208 and the second linear prediction device 222. For the spectral representation of FIG. 4*c*, the frequency in Hz is plotted on the x-axis versus the energy transported in the given frequency in units of dB on the y-axis.

The solid line 240 describes the original spectral envelope of the processed signal, whereas the dashed line 242 gives the result obtained by linear predictive coding (LPC) using the values of the spectral envelope at the marked equidistant frequency values. For the example shown in FIG. 4*c*, the predictor order p is 30, the comparatively high predictor order explaining the close match of the predicted spectral envelope 242 and the real spectral envelope 240. This is due to the fact that the predictor is able to describe more fine structure, the higher the predictor order.

FIG. 4*d* shows the effect of lowering the predictor order p or of applying a bandwidth expansion factor ρ. FIG. 4*d* shows two examples of estimated envelopes in the same representation as in FIG. 4*c*, i.e. the frequency on the x-axis and the energy on the y-axis. A estimated envelope 244 represents a spectral envelope obtained from linear predictive coding with a given predictor order. The filtered envelope 246 shows the result of linear predictive coding on the same signal with reduced predictor order p or, alternatively, with a bandwidth expansion factor row applied. As can be seen, the filtered envelope 246 is much smoother than the estimated envelope 244. This means that at the frequencies, where the estimated envelope 244 and the filtered envelope 246 differ at most, the filtered envelope 246 describes the real envelope less precise than the estimated envelope 244. Hence, an inverse filtering based on the filtered envelope 246 yields a flattened spectrum, that is flattened less as if using the parameters from the estimated envelope 244 in the inverse filtering process. The inverse filtering is described in the following paragraph.

The parameters or coefficients $\alpha_k$ estimated by the linear predicted devices are used by the inverse filters 210 and 224, to do the spectral flattening of the signals, i.e. the inverse filtering by using the following inverse filter function:

$$H_{inv}(z, p, \rho) = \frac{1 - \sum_{k=1}^{p} \alpha_k (z\rho)^{-k}}{G}$$

where p is the predictor order and ρ is the optional bandwidth expansion factor.

The coefficients $\alpha_k$ can be obtained in different manners, e.g. the autocorrelation method or the covariance method. It is common practice to add some sort of relaxation to the estimate in order to ensure stability of the system. When using the autocorrelation method this is easily accomplished by offsetting the zero-lag value of the correlation vector. This is equivalent to addition of white noise at a constant level to the signal used to estimate A(z).

The gain calculator 230 calculates the short time target energies, i.e. the energies needed within the single samples of the wet signal to fulfil the requirement of an envelope of the wet signal that is shaped to the envelope of the dry signal. These energies are calculated based on the spectrally flattened dry signal and based on the spectrally flattened wet signal. A derives gain adjustment value can then be applied to the wet signal by the envelope shaper 232.

Before describing the gain calculator 230 in mote detail, it may be noted, that during the inverse filtering the gain factor C of the inverse filters 210 and 224 needs to be taken care for. Since the dry and wet signals operated on are output signals from an upmix-process that has produced two output signals for every channel, wherein the first channel has a specific energy ratio with respect to the second channel according to the ILD and ICC parameters used for the upmixed process, it is essential that this relation is maintained in average over the time segment for which the ILD and ICC parameters are valid in the course of the temporal envelope shaping. Stated differently, the apparatus for processing a decorrelated signal 200 shall only modify the temporal envelope of the decorrelated signal, while maintaining the same average energy of the signal over the segment being processed.

The gain calculator 230 operates on the two spectrally flattened signals and calculates a short-time gain function for application on the wet signal over time segments much shorter than the segments used for inverse filtering. For example, when the segment length for inverse filtering is 2048 samples, the short-term gain factors may be computed for samples of a length of 64. This means that on the basis of spectra, that are flattened over a length of 2048 samples, gain factors are derived for temporal energy shaping using much shorter segments of the signal as, for example, 64.

The application of the calculated gain factors to the wet signal is done by the envelope shaper 232 that multiplies the calculated gain factors with the sample parameters. Finally the high-pass filtered, envelope shaped wet signal is added to its low frequency part by the adder (upmixer) 234, yielding the finally processed and envelope shaped wet signal at the output of the envelope shaper 234.

As energy preservation and smooth transition between different gain factors is an issue as well during the inverse filtering as during the application of the gain factor, windowing functions may additionally be applied to calculated gain factors to guarantee for a smooth transition between gain factors of neighbouring samples. Therefore, the inverse filtering step and the application of the calculated short-term gain factors to the wet signals are described in more detail within FIGS. 5*a*, 5*b* and 6 in later paragraphs, assuming the example mentioned above with a segment length of 2048 for inverse filtering and with a segment length of 64 for calculation of the short-term gain factors.

FIG. 4*b* shows a modification of the inventive apparatus for processing a decorrelated signal 200, where the envelope shaped wet signal is supplied to a high-pass filter 240 after the envelope shaping. In a preferred embodiment, the high-pass filter 224 has the same characteristics as the high-pass filter 220 deriving the part of the wet signal 202 that is filtered. Then, the high-pass filter 240 ensures that any introduced distortion in the decorrelated signal does not alter the high-pass character of the signal, thus introducing a miss-match in the summation of the unprocessed low-pass part of the decorrelated signal and the processed high-pass part of the signal.

Several important features of the above-outlined implementation of the present invention should again be emphasized:

- the spectral flattening is done by calculating a spectral envelope representation (in this particular example by means of LPC) of a time segment significantly longer than a time segment used for short-time energy adjustment;
- the spectral flattened signal is only used to calculate the energy estimates upon which the gain values are calculated that are used to estimate and apply the correct temporal envelope of the decorrelated (wet) signal;
- the mean energy ratio between the wet signal and the dry signal is maintained, it is only the temporal envelope that is modified. Hence, the average of the gain values G over the signal segment being processed (i.e. a frame comprising typically 1024 or 2048 samples), is approximately equal to one for a majority of signals.

Figure 5A:
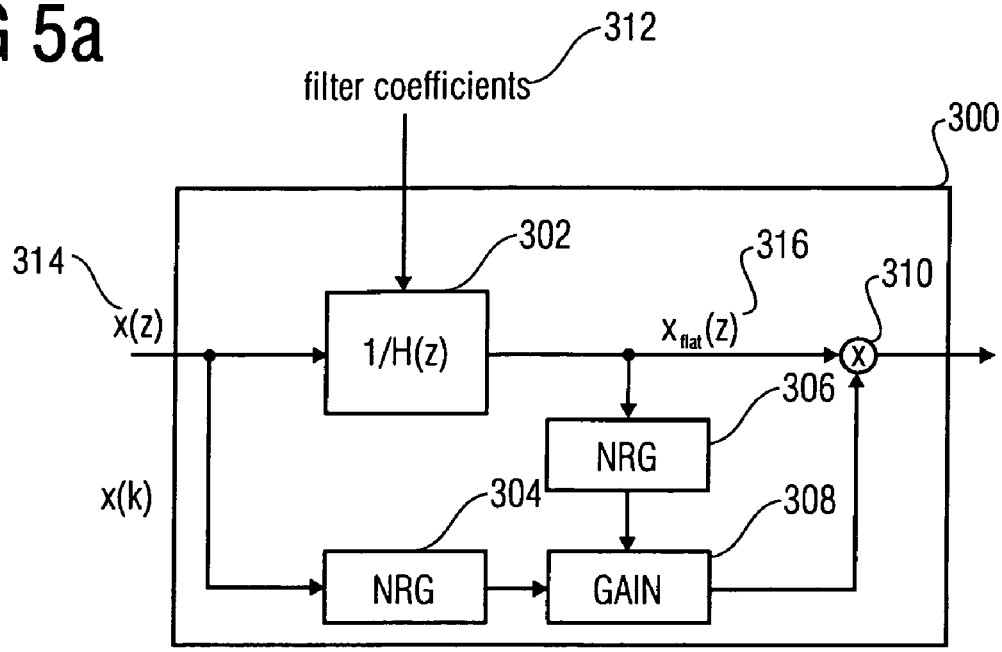
FIG. 5*a* shows an inventive spectral flattener.

FIG. 5*a* shows a more detailed description of an inverse filter used as first inverse filter 210 and as second inverse filter 224 within the inventive apparatus for processing a decorrelated signal 200. The inverse filter 300 comprises an inverse transformer 302, a first energy calculator 304, a second energy calculator 306, a gain calculator 308 and a gain applier 310. The inverse transformer 302 receives filter coefficients 312 (as derived by linear predictive coding) and the signal X(k) 314 as input. A copy of the signal 314 is input into the first energy calculator 304. The inverse transformer applies the inverse transformation based on the filter coefficients 312 to the signal 314 for a signal segment of length 2048. The gain factor G is set to 1, therefore, a flattened signal 316 ($X_{flat}(z)$) is derived from the input signal 314 according to the following formula:

$$X_{flat}(z) = \frac{X(z)}{H(z)}$$

As this inverse filtering does not necessarily preserve the energy, the long-term energy of the flattened signal has to be preserved by means of a long term gain factor $g_{long}$. Therefore, the signal 214 is input into the first energy calculator 304 and the flattened signal 316 is input into the second energy calculator 306, where the energies of the signal E and of the flattened signal $E_{flat}$ are computed as follows:

$$E = \sum_k (x(k))^2,\ 0 \le k < 2048$$

$$E_{flat} = \sum_k (x_{flat}(k))^2,\ 0 \le k,\ 2048$$

where the current segment length for spectral envelope estimation and inverse filtering is 2048 samples.

Hence, the gain factor $g_{long}$ can be computed by the gain calculator 308 using the following equation:

$$g_{long} = \sqrt{\frac{E}{E_{flat}}}$$

By multiplying the flattened signal 316 with the derived gain factor $g_{long}$, energy preservation can be assured by the gain applier 310. To ensure a smooth transition between neighbouring signal segments, in a preferred embodiment, the gain factor $g_{long}$ is applied to the flattened signal 316 using a window function. Thus, a jump in the loudness of the signal can be avoided, which would heavily disturb the perceptual quality of the audio signal.

Figure 5B:
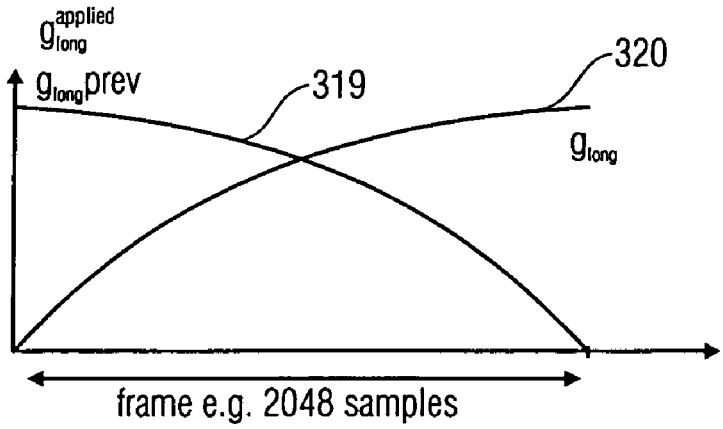
FIG. 5*b* shows an application scheme of long-term energy correction.

The long-term gain factor $g_{long}$ can for example be applied according to FIG. 5*b*. FIG. 5 shows a possible window function in a graph, where the number of samples is drawn on the x-axis, whereas the gain factor g is plotted on the y-axis. A window spanning the entire frame of 2048 samples is used fading out the gain value from the previous frame 319 and fading-in the gain value 320 of the present frame.

Applying inverse filters 300 within the inventive apparatus for processing a decorrelated signal 200 assures, that the signals after the inverse filters are spectrally flattened while the energy of the input signals is furthermore preserved.

Based on the flattened wet and dry signals, the gain factor calculation can be performed by the gain calculator 230. This shall be explained in more detail within the following paragraphs, where a windowing function is additionally introduced to assure for a smooth transition of the gain factors used to scale neighbouring signal segments. In the example shown in FIG. 6, the gain factors calculated for neighbouring segments are valid for 64 samples each, wherein they are additionally scaled by a windowing function win(k). The energy within the single segments are calculated according to the following formulas, where N denotes the segment number within the long-term segment used for spectral flattening, i.e. a segment having 2048 samples:

$$E_{wet}(n) = \sum_k (x(k+32n)win(k))^2,\ 0 \le k < 64,\ 0 \le n < N$$

$$E_{dry}(n) = \sum_k (x(k+32n)win(k))^2,\ 0 \le k < 64,\ 0 \le n < N$$

Figure 6:
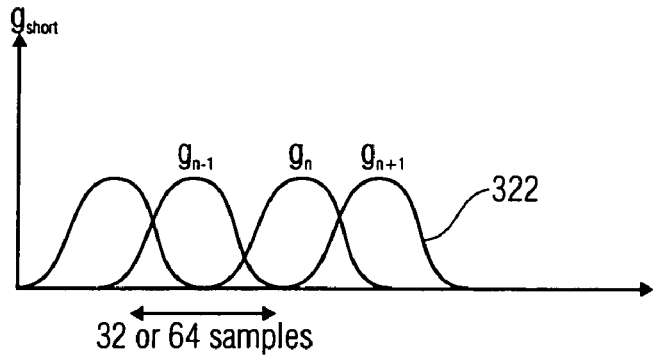
FIG. 6 shows an application scheme for short-term energy correction.

Here, win(k) is a window function 322, as shown in FIG. 6 that has, in this example, a length of 64 samples. In other words, the short-time gain function is calculated similarly to the gain calculation of the long-term gain factor $g_{long}$, albeit over much shorter time segments. The single gain values $G_N$ to be applied to the single short-time samples are then calculated by the gain calculator 230 according to:

$$g_n = \sqrt{\frac{E_{dry}(n)}{E_{wet}(n)}},\ 0 \le n < N$$

The gain values calculated above are applied to the wet signal using windowed overlap add segments as outlined in FIG. 6. In one preferred embodiment of the present invention the overlap-add windows are 32 samples long at a 44.1 kHz sampling rate. In another embodiment a 64 sample window is used. As previously stated, one of the advantageous features of implementing the present invention in the time domain, is the freedom of choice of time resolution of the temporal envelope shaping. The windows outlined in FIG. 6 can also be used in module 230 where the gain values $g_{n-1}, g_n \ldots g_N$. are being calculated.

It may be noted, that given the requirement that the energy relation between the wet and dry signals should be maintained over the processed segment as calculated by the upmix based on the ILD and ICC parameters, it is evident that an average gain value averaged over the gain values $g_{n-1}, g_n \ldots g_N$ shall be approximately equal to one for a majority of signals. Hence, returning to the calculation of the long term gain adjustment, in a different embodiment of the present invention the gain factor can be calculated as $$g_{long} = \sqrt{\frac{1}{E_{flat}}}.$$

Hence, the wet and dry signals are normalised, and the long term energy ratio between the two is approximately maintained.

Although the examples of the present invention detailed in the paragraphs above are performing temporal envelope shaping of a decorrelated signal in the time domain, it is evident from the derivation of the wet and dry signals above, that the temporal shaping module can be made to operate as well on the QMF subband signal output of a decorrelator unit prior to using the decorrelator signal for the final upmix stage.

Figure 7A:
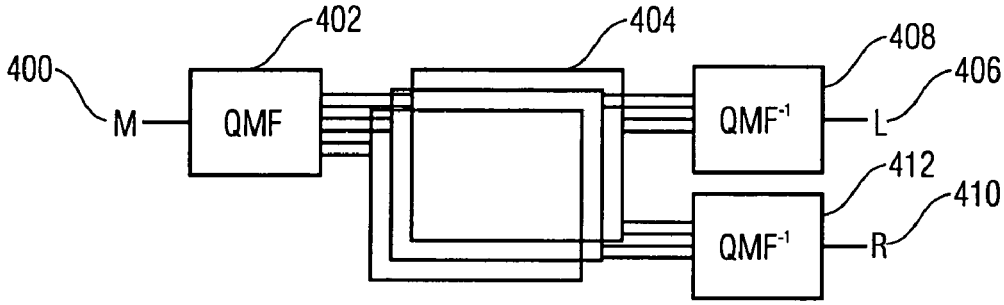
FIG. 7*a* shows an inventive apparatus within a QMF-filterbank design.

This is sketched in FIG. 7*a*. There, a incoming mono signal 400 is input into a QMF filter bank 402, deriving a subband representation of a monophonic signal 400. Then, in a signal processing block 404, the upmix is performed for each subband individually. Hence, a final reconstructed left signal 406 can be provided by a QMF synthesis block 408, and a final reconstructed right channel 410 can be provided by a QMF synthesis block 412.

Figure 7B:
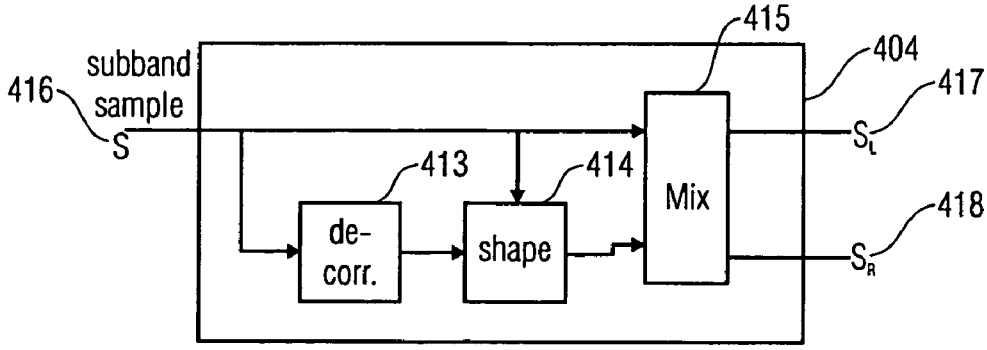
FIG. 7*b* shows details of the inventive apparatus of FIG. 7*a;*

An example for a signal processing block 404 is given in FIG. 7*b*. The signal processing block 404 is having a decorrelator 413, an inventive apparatus for processing a decorrelated signal 414 and an upmixer 415.

A single subband sample 416 is input into the signal processing block 404. The decorrelator 413 is deriving a decorrelated sample from the subband sample 416 which is input into the apparatus for processing a decorrelated signal 414 (shaper). The shaper 414 is receiving a copy of the subband sample 416 as a second input. The inventive shaper 414 is performing the temporal envelope shaping according to the present invention and providing a shaped decorrelated signal to a first input of the upmixer 415 that is additionally receiving the subband sample 416 at a second input. The upmixer 415 is deriving a left subband sample 417 and a right subband sample 418 from both the subband sample 416 and the shaped decorrelated sample.

By integrating multiple signal processing blocks 404 for different subband samples, left and right subband samples can be calculated for each subband of a filterbank domain.

In multi-channel implementations, signal procession is normally done in the QMF domain. It is also clear, given the above, that the final summation of the decorrelated signal and the direct version of the signal can be done as a final stage just prior to forming the actual reconstructed output signal. Hence, the shaping module can also be moved to be performed just prior to the addition of the two signal components, provided that the shaping module does not change the energy of the decorrelated signal as stipulated by the ICC and ILD parameters, but only modifies the short-term energies giving the decorrelated signal a temporal envelope closely matching the direct signal.

Operating the present invention in the QMF subband domain prior to upmix and synthesis or operating the present invention in the time-domain, after upmix and synthesis are two different approaches both having their distinct advantages and disadvantages. The former being the simplest and requires the least amount of computations albeit limited to the time-resolution of the filterbank it is operating in. While the latter requires additional synthesis filter-banks and therefore additional computational complexity, it has complete degree of freedom when choosing time resolution.

Figure 8:
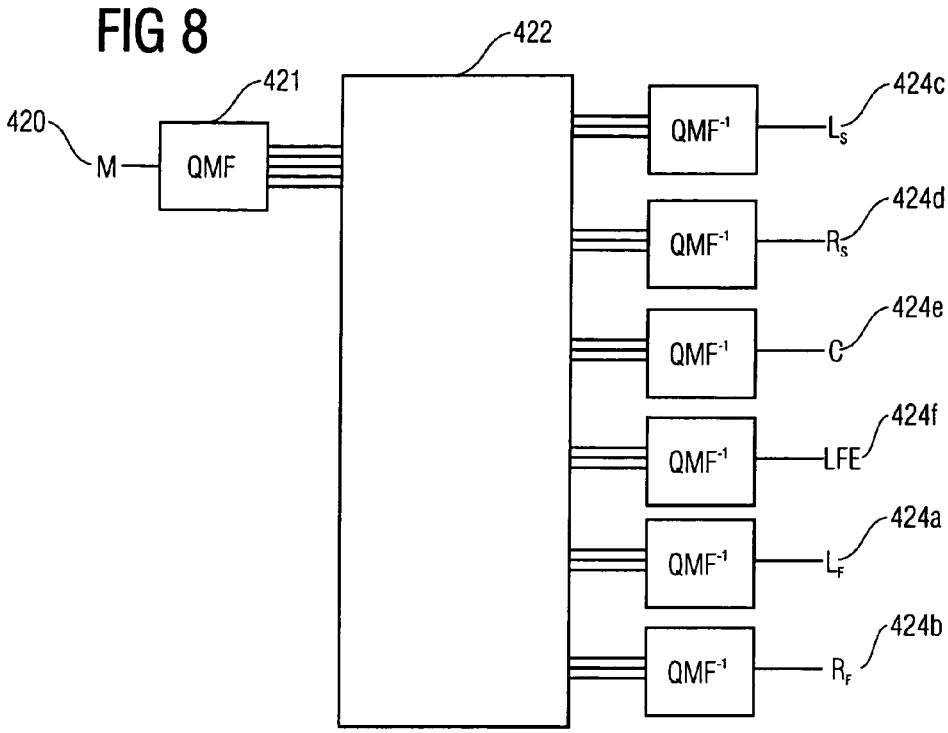
FIG. 8 shows the use of an inventive apparatus within a multi-channel audio decoder.

As already mentioned above, multi-channel decoders mostly perform the signal processing in the subband domain as shown in FIG. 8. There, a monophonic downmix signal 420, that is a downmix of a original 5.1 channel audio signal, is input into a QMF filterbank 421 that derives the subband representations of the monophonic signal 420. The actual upmix and signal reconstruction is then performed by a signal processing block 422 in the subband domain. As final step, the original 5.1 channel signal, comprising a left-front channel 424*a*, a right-front channel 424*b*, a left-surround channel 424*c*, a right-surround channel 424*d*, a center channel 424*e* and a low-frequency enhancement channel 424*f* are derived by QMF synthesis.

Figure 9:
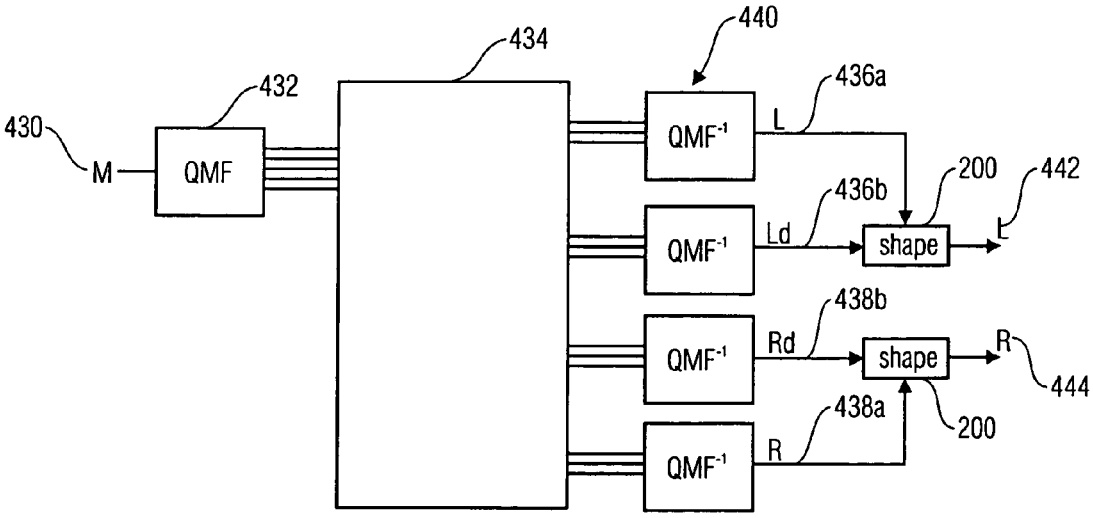
FIG. 9 shows the application of an inventive apparatus after the inverse filtering in a QMF based design.

FIG. 9 shows a further embodiment of the present invention, where the signal shaping is shifted to the time domain, after the processing and the upmixing of a stereo-phonic signal has been done within the subband domain.

A monophonic input signal 430 is input into a filterbank 432, to derive the multiple subband representations of the monophonic signal 430. The signal processing and upmixing of the monophonic signal into 4 signals is done by a signal processing block 434, deriving subband representations of a left dry signal 436*a*, a left wet signal 436*b*, a right dry signal 438*a* and a right wet signal 438*b*. After a QMF synthesis 440, a final left signal 442 can be derived from the left dry signal 436*a* and the left wet signal 436*b* using an inventive apparatus for processing a decorrelated signal 200, operative in the time domain. In the same way, a final right signal 444 can be derived from the right dry signal 438*a* and the right wet signal 438*b*.

As mentioned before, the present invention is not limited to be operated on a time domain signal. The inventive feature of long-term spectral flattening in combination with the short-term energy estimation and adjustment can also be implemented in a subband filterbank. In the previously shown examples, a QMF filterbank is used, however, it should be understood that the invention is by no means limited to this particular filterbank representation. According to the time domain implementation of the present invention, the signal used for estimation of the temporal envelope, i.e. the dry signal and the decorrelated signal going into the processing unit, are high-pass filtered, in the case of a QMF filterbank representation by means of setting QMF subbands to 0 in the lower-frequency range. The following paragraphs exemplify the use of the inventive concept in a QMF subband domain, where m denotes the subband, i.e. a frequency range of the original signal, and N denotes the sample number within the subband representation, and where the signal subband used for the long-term spectral flattening comprises N samples.

Now assuming that $$E_{dry}(m,n)=Q_{dry}(m,n)Q_{dry}^{*}(m,n), m_{start}\leqq m<M, 0\leqq n<N$$

$$E_{wet}(m,n)=Q_{wet}(m,n)Q_{wet}^{*}(m,n), m_{start}\leqq m<M, 0\leqq n<N$$

where $Q_{dry}(m,n)$ and $Q_{wet}(m,n)$ are the QMF subband matrices holding the dry and the wet signal, and where $E_{dry}(m,n)$ and $E_{wet}(m,n)$ are the corresponding energies for all subband samples. Here, m denotes the subband, starting at $m_{start}$ being chosen to correspond to approx 2 kHz, and where n is the subband sample index running from zero to N, the number of subband samples within a frame being, which is 32 in one preferred embodiment, corresponding to approx 20 ms.

For both energy matrices above the spectral envelope is calculated as an average over all subband samples in the frame. This corresponds to the long term spectral envelope.

$$Env_{dry}(m) = \frac{1}{N}\sum_{n=0}^{N} E_{dry}(m, n),\ m_{start} \leq m < M$$

$$Env_{wet}(m) = \frac{1}{N}\sum_{n=0}^{N} E_{wet}(m, n),\ m_{start} \leq m < M$$

Furthermore, the mean total energy over the frame is calculated according to:

$$E_{dry} = \frac{1}{M - m_{start}} \sum_{m=m_{start}}^{M} Env_{dry}(m)$$

$$E_{wet} = \frac{1}{M - m_{start}} \sum_{m=m_{start}}^{M} Env_{wet}(m)$$

Based on the equations above, a flattening gain curve can be calculated for the two matrices:

$$g_{dry}(m) = \frac{E_{dry}}{Env_{dry}(m)},\ m_{start} \le m < M$$

$$g_{wet}(m) = \frac{E_{wet}}{Env_{wet}(m)},\ m_{start} \le m < M$$

By applying the gain curve calculated above to the energy matrices for the wet and dry signal, long term spectrally flat energy matrices are obtained according to:

$$E_{dry}^{Flat}(m,n)=g_{dry}(m)E_{dry}(m,n), m_{start} \leqq m < M, 0 \leqq n < N$$

$$E_{wet}^{Flat}(m,n)=g_{wet}(m)E_{wet}(m,n), m_{start} \leqq m < M, 0 \leqq n < N$$

The above energy matrices are used to calculate and apply the temporal envelope of the wet signal using the highest time resolution available in the QMF domain.

$$Q_{wet}^{Adjusted}(m, n) = Q_{wet}(m, n)\sqrt{\frac{E_{dry}^{Flat}(m, n)}{E_{dry}^{Flat}(m, n)}},$$

$$m_{start} \le m < M,\ 0 \le n < N$$

From the above description of the present invention implemented in the subband domain, it is clear that the inventive step of doing the long term spectral whitening in combination with short term time envelope estimation, or short time energy estimation/adjustment is not limited to usage of LPC in the time domain.

In a further embodiment of the present invention, temporal envelope shaping is used in the subband domain in the frequency direction, to perform the inventive spectral flattening, before applying temporal envelope shaping to the wet signal.

It is know from prior art that a signal represented in the frequency domain with low time resolution can be time envelope shaped by filtering in the frequency direction of the frequency representation of the signal. This is used in perceptual audio codecs to shape introduced quantization noise of a signal represented in a long transform [J. Herre and J. D. Johnston, "Enhancing the performance of perceptual audio coding by using temporal noise shaping (TNS)," in 101st AES Convention, Los Angeles, November 1996.].

Assuming a QMF filterbank with 64 channels and a prototype filter of 640 samples, it is evident that the time resolution of the QMF subband representation is not as high as when the temporal shaping is done in the time domain on windows in the ms range. One way of shaping a signal in the QMF domain with higher time resolution than natively available in the QMF, is to do linear prediction in the frequency direction. Hence, observing the dry signal in the QMF domain above for a certain QMF slot, i.e. for a subband sample n, $$Q_{dry}(m,n), m_{start} \leqq m < M, 0 \leqq n < N$$

A linear predictor $$H_n(z) = \frac{G}{A_n(z)}$$

can be estimated, where $$A_n(z) = 1 - \sum_{k=1}^{p} \alpha_k z^{-k}$$

is the polynomial obtained using the autocorrelation method or the covariance method. Again it is important to note that contrary to LPC in the time-domain, as was outlined earlier, the here estimated linear predictor is devised to predict the complex QMF subband samples in the frequency direction.

Figure 10:
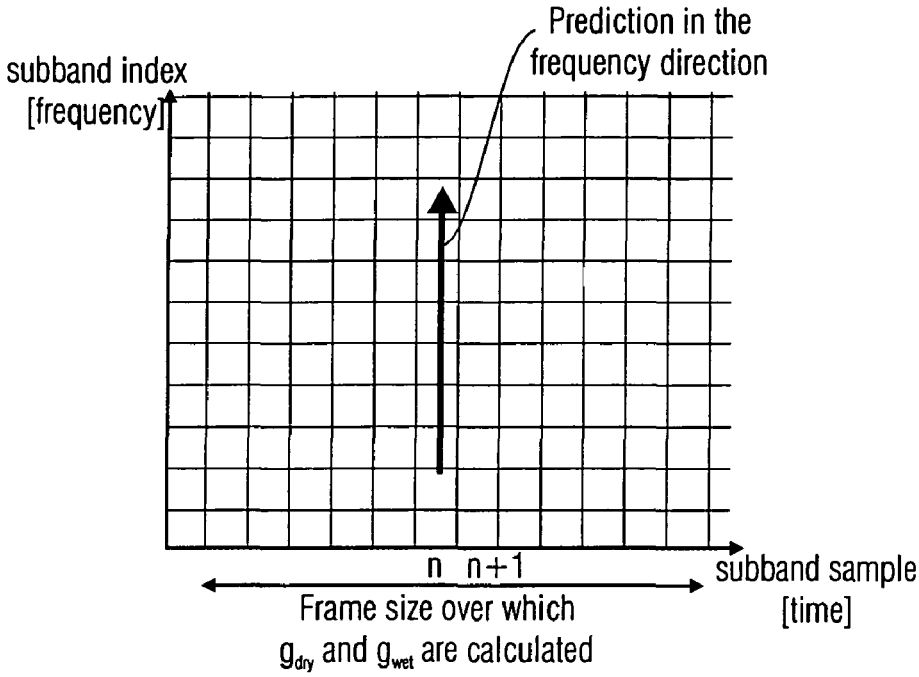
FIG. 10 shows the time-versus frequency representation of a signal with a filterbank representation.

In FIG. 10, the time/frequency matrix of the QMF is displayed. Every column corresponds to a QMF time-slot, i.e. a subband sample. The rows corresponds to the subbands. As is indicated in the figure, the estimation and application of the linear predictor takes place independently within every column. Furthermore, one column outlined in FIG. 10 correspond to one frame being processed. The frame size over which the whitening gain curves $g_{wet}(m)$ and $g_{dry}(m)$ are estimated is also indicated in the figure. A frame size of 12 would for example mean processing 12 columns simultaneously.

In the previously described embodiment of the present invention, the linear prediction in the frequency direction is done in a complex QMF representation of the signal. Again, assuming a QMF filterbank with 64 channels and a prototype filter of 640 samples, and keeping in mind that the predictor operates on a complex signal, a very low order complex predictor is sufficient to track the temporal envelope of the signal within the QMF slot where the predictor is applied. A preferred choice is predictor order 1.

The estimated filter $H_n$ corresponds to the temporal envelope of a QMF signal for the specific subband sample, i.e. a temporal envelope not available by just observing the subband sample (since only one sample is available). This subsample temporal envelope can be applied to the $Q_{wet}$ signal by filtering the signal in the frequency direction through the estimated filter, according to:

$$Q_{wet}^{Adjusted}(m,n)=Q_{wet}(m,n)*h_n, m_{start} \leqq m < M$$

where m is the QMF slot, or subband sample, used for predictor estimation, and undergoing temporal shaping.

Although the wet signal being produced by the decorrelator has a very flat temporal envelope, it is recommended to first remove any temporal envelope on the wet signal prior to applying that of the dry signal. This can be achieved by doing the same temporal envelope estimation using linear prediction in the frequency direction as outlined above, albeit on the wet signal, and using the filter obtained to inverse filter the wet signal, thus removing any temporal envelope, prior to applying the temporal envelope of the dry signal.

In order to get an as closely matching temporal envelope of the wet signal as possible, it is important that the estimate of the temporal envelope derived by means of the linear predictor in the frequency direction of the dry signal is as good as possible. The present invention teaches that the dry signal should undergo long term spectral flattening prior to the estimation of its temporal envelope by means of linear prediction. Hence, the previously calculated gain curve $$g_{dry}(m), m_{start} \leqq m < M$$

should be applied to the dry signal used for temporal envelope estimation according to:

$$Q_{dry}^{Flat}(m,n) = Q_{dry}(m,n) g_{dry}(m), m_{start} \leqq m < M, 0 \leqq n < N$$

where n denotes the QMF slots, and m denotes the subband index. It is evident that the gain correction curve is the same for all subbands samples within the present frame being processed. This is obvious since the gain curve corresponds to the required frequency selective gain adjustment in order to remove the long term spectral envelope. The obtained complex QMF representation $Q_{dry}^{Flat}(m,n)$ is used for estimating the temporal envelope filter using linear prediction as outlined above.

The additional time resolution offered by the LPC filtering aims at shaping the wet signal for transient dry signals. However, due to the use of a limited dataset of one QMF slot for the LPC estimation there is still a risk that fine temporal shaping is applied in a chaotic fashion. To reduce this risk while keeping the performance for transient dry signals, the LPC estimation can be smoothed over a few time slots. This smoothing has to take into consideration the evolution over time of the frequency direction covariance structure of the applied filter bank's analysis of an isolated transient event. Specifically, in the case of first order prediction and an oddly stacked complex modulated filter bank with a total oversampling factor of two, the smoothing taught by this invention consists of the following modification on the prediction coefficient $\alpha_n$ used in time slot n, $$a_n \mapsto a_n^{smoothed} = \sum_{k=-d}^{k=d} (-1)^d a_{n+k},$$

where $d \geqq 1$ defines the prediction block size in the time direction.

Figure 11:
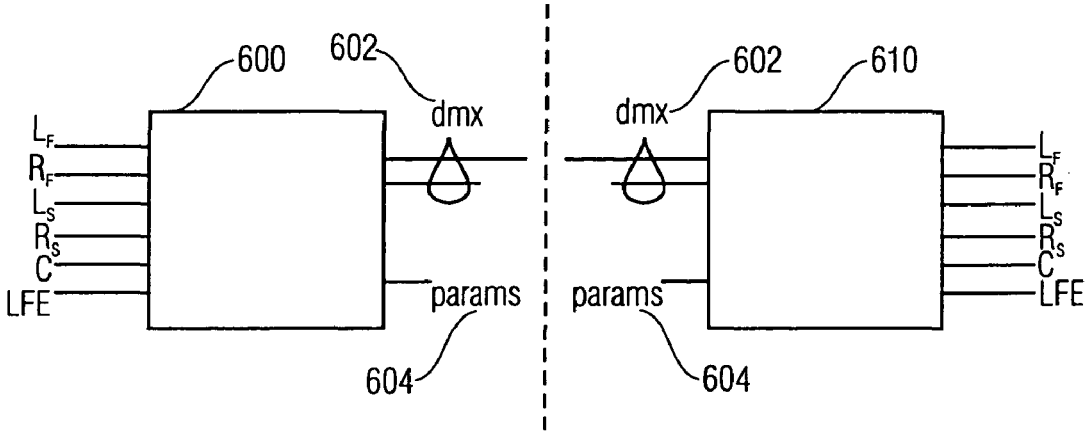
FIG. 11 shows a transmission system having an inventive decoder.

FIG. 11 shows a transmission system for a 5.1 input channel configuration, having a 5.1 channel encoder 600 that downmixes the 6 original channels into a downmix 602 that can be monophonic or comprise several discrete channels and additional spatial parameters 604. The downmix 602 is transmitted to the audio decoder 610 together with the spatial parameters 604.

The decoder 610 is having one or more inventive apparatuses for processing a decorrelated signal to perform an upmix of the downmix signal 602 including the inventive temporal shaping of the decorrelated signals. Thus, in such a transmission system, application of the inventive concept on a decoder side leads to an improved perceptual quality of the reconstructed 5.1 channel signal.

The above-described embodiments of the present invention are merely illustrative for the principles of the present invention and for methods for improved temporal shaping of decorrelated signals. It is understood that modifications and variations of the arrangements and the details described herein will be apparent to others skilled in the art. It is the intent therefore, to be limited only by the scope of the impending patent claims, but not by the specific details presented by way of description and explanation of the embodiments herein. It is also understood that the explanation of the present invention is carried-out by means of two channels and 5.1 channel examples, while it is obvious to others skilled in the art that the same principles apply for arbitrary channel configurations and, hence, the present invention is not limited to a specific channel configuration or embodiment with a specific number of in-/output channels. The present invention is applicable to any multi-channel reconstruction that utilises a decorrelated version of a signal and, hence, it is furthermore evident to those skilled in the art that the invention is not limited to the particular way of doing multi-channel reconstruction used in the exemplifications above.

In short, the present invention primarily relates to multi-channel reconstruction of audio signals based on an available downmix signal and additional control data. Spatial parameters are extracted on the encoder side representing the multi-channel characteristics given a downmix of the original channels. The downmix signal and the spatial representation is used in a decoder to recreate a close resembling representation of the original multi-channel signal, by means of distributing a combination of the downmix signal and a decorrelated version of the same to the channels being reconstructed. The invention is applicable in systems where a backwards compatible downmix signal is desirable, such as stereo digital radio transmission (DAB, XM satellite radio etc), but also to systems that require a very compact representation of the multi-channel signal.

The flattening of the spectrum was performed by inverse filtering based on filter coefficients derived by LPC analysis in the examples described above. It is understood that any further operation yielding a signal with a flattened spectrum is suited to be implemented to build a further embodiment of the present invention. The application would result in a reconstructed signal having the same advantageous properties.

Within a multi-channel audio decoder the place in the signal path, where the present invention is applied, is irrelevant for the inventive concept of improving the perceptual quality of a reconstructed audio signal using an inventive apparatus for processing a decorrelated signal.

Although, in a preferred embodiment, only a high-pass filtered part of the wet signal is envelope-shaped according to the present invention, the present invention may also be applied on a wet signal having the full spectrum.

The windowing functions, used to apply gain corrections to the long-term spectrally flattened signals as well as to the short-term envelope shaping gain factors are to be understood as examples only. It is evident, that other window functions may be used that allow for a smooth transition of gain functions between neighbouring segments of the signal to be processed.

Depending on certain implementation requirements of the inventive methods, the inventive methods can be implemented in hardware or in software. The implementation can be performed using a digital storage medium, in particular a disk, DVD or a CD having electronically readable control signals stored thereon, which cooperate with a programmable computer system such that the inventive methods are performed. Generally, the present invention is, therefore, a computer program product with a program code stored on a machine readable carrier, the program code being operative for performing the inventive methods when the computer program product runs on a computer. In other words, the inventive methods are, therefore, a computer program having a program code for performing at least one of the inventive methods when the computer program runs on a computer.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concepts disclosed herein and comprehended by the claims that follow.

What is claimed is:

1. Apparatus for processing a decorrelated signal derived from an original signal or a combination signal derived by combining the original signal and the decorrelated signal, comprising:

a spectral flattener for spectral flattening of the decorrelated signal, a signal derived from the decorrelated signal or the combination signal to obtain a flattened signal, and for spectral flattening of the original signal or a signal derived from the original signal to obtain a second flattened signal, the spectral flattener being operative such that a flattened signal has a flatter spectrum than a corresponding signal before flattening;

a time envelope shaper for time envelope shaping the decorrelated signal or the combination signal using information on the first and second flattened signals; and wherein the spectral flattener or the time envelope shaper includes a hardware implementation.

2. Apparatus in accordance with claim 1, in which the time envelope shaper is operative to shape the time envelope of the decorrelated signal or the combination signal using a gain factor.

3. Apparatus in accordance with claim 1, in which the time envelope shaper is operative to shape the time envelope of the decorrelated signal or the combination signal using a gain factor derived by comparing the energies comprised within corresponding portions of the first flattened signal and the second flattened signal.

4. Apparatus in accordance with claim 1, in which the spectral flattener is operative to derive the flattened master signal from the original signal.

5. Apparatus in accordance with claim 1, in which the spectral flattener is operative to derive the flattened master signal from the signal derived from the original signal.

6. Apparatus in accordance with claim 1, in which the spectral flattener is operative to flatten a first portion of the decorrelated signal or the combination signal; and in which the time envelope shaper is operative to shape a second portion of the decorrelated signal or the combined signal, wherein the second portion is included in the first portion.

7. Apparatus in accordance with claim 6, in which the size of the first portion is more than 10 times the size of the second portion.

8. Apparatus in accordance with claim 1, in which the spectral flattener is operative to flatten the spectrum by means of filtering using filter coefficients derived by linear predictive coding.

9. Apparatus in accordance with claim 8, in which the spectral flattener is operative to flatten the spectrum by means of filtering using filtering coefficients derived using linear prediction in the time direction.

10. Apparatus in accordance with claim 1, in which the spectral flattener is operative to obtain a spectrally flattened representation of a signal in the time domain.

11. Apparatus in accordance with claim 1, in which the spectral flattener is operative to obtain a spectrally flattened representation of a signal in a subband domain.

12. Apparatus in accordance with claim 1, in which the spectral flattener and the time envelope shaper are operative to process all frequencies of a full spectrum decorrelated signal that are above a given frequency threshold.

13. Method for processing a decorrelated signal derived from an original signal or a combination signal derived by combining the original signal and the decorrelated signal, the method comprising:

spectrally flattening the decorrelated signal, a signal derived from the decorrelated signal or the combination signal to obtain a flattened signal, and for spectral flattening of the original signal or a signal derived from the original signal to obtain a second flattened signal, a flattened signal having a flatter spectrum than a corresponding signal before flattening;

time envelope shaping the decorrelated signal or the combination signal using information on the first and second flattened signal; and wherein the method is performed by a hardware apparatus.

14. Spatial audio decoder, comprising:

an input interface for receiving an original signal derived from a multi channel signal having at least two channels and for receiving spatial parameters describing an interrelation between a first channel and a second channel of the multi channel signal;

a decorrelator for deriving a decorrelated signal from the original signal using the spatial parameters;

a spectral flattener for spectral flattening of the decorrelated signal, a signal derived from the decorrelated signal or a combination signal derived by combining the original signal and the decorrelated signal to obtain a first flattened signal, and for spectral flattening of the original signal or a signal derived from the original signal to obtain a second flattened signal, the spectral flattener being operative such that a flattened signal has a flatter spectrum than a corresponding signal before flattening;

a time envelope shaper for time envelope shaping the decorrelated signal or the combination signal using information on the first and the second flattened signal; and wherein the input interface, the decorrelator, the spectral flattener or the time envelope shaper includes a hardware implementation.

15. Receiver or audio player, having an apparatus for processing a decorrelated signal derived from an original signal or a combination signal derived by combining the original signal and the decorrelated signal, comprising:

a spectral flattener for spectral flattening of the decorrelated signal, a signal derived from the decorrelated signal or the combination signal to obtain a flattened signal, and for spectral flattening of the original signal or a signal derived from the original signal to obtain a second flattened signal, the spectral flattener being operative such that a flattened signal has a flatter spectrum than a corresponding signal before flattening;

a time envelope shaper for time envelope shaping the decorrelated signal or the combination signal using information on the first and second flattened signals; and wherein the spectral flattener or the time envelope shaper includes a hardware implementation.

16. Method of receiving or audio playing, the method having a method for processing a decorrelated signal derived from an original signal or a combination signal derived by combining the original signal and the decorrelated signal, the method comprising:

spectrally flattening the decorrelated signal, a signal derived from the decorrelated signal or the combination signal to obtain a flattened signal, and for spectral flattening of the original signal or a signal derived from the original signal to obtain a second flattened signal, a flattened signal having a flatter spectrum than a corresponding signal before flattening;

time envelope shaping the decorrelated signal or the combination signal using information on the first and second flattened signals; and wherein the method is performed by a hardware apparatus.

17. Non-transitory storage medium having stored thereon a computer program for performing, when running on a computer, a method in accordance with claim 13.

18. Non-transitory storage medium having stored thereon a computer program for performing, when running on a computer, a method in accordance with claim 16.

* * * * *